US008251639B2

(12) United States Patent
Talan

(10) Patent No.: US 8,251,639 B2
(45) Date of Patent: Aug. 28, 2012

(54) GAS TURBINE WITH AT LEAST ONE MULTI-STAGE COMPRESSOR UNIT INCLUDING SEVERAL COMPRESSOR MODULES

(75) Inventor: Metin Talan, Berlin (DE)

(73) Assignee: Rolls-Royce Deutchland Ltd Co KG (DE)

( * ) Notice: Subject to any disclaimer, the term of this patent is extended or adjusted under 35 U.S.C. 154(b) by 603 days.

(21) Appl. No.: 12/486,355

(22) Filed: Jun. 17, 2009

(65) Prior Publication Data

US 2009/0314003 A1 Dec. 24, 2009

(30) Foreign Application Priority Data

Jun. 18, 2008 (DE) ..... 10 2008 028 883

(51) Int. Cl.
*F02C 6/00* (2006.01)

(52) U.S. Cl. ..... 415/1; 415/122.1; 416/1; 416/32; 416/169 R; 416/198 R; 416/130

(58) Field of Classification Search ..... 415/1, 122.1; 416/1, 32, 169 R, 198 R, 124, 127, 129, 130
See application file for complete search history.

(56) References Cited

U.S. PATENT DOCUMENTS 3,385,064 A * 5/1968 Wilde et al. ..... 416/198 A
3,422,625 A * 1/1969 Harris ..... 416/127
3,719,428 A * 3/1973 Dettmering ..... 415/181
7,791,235 B2 * 9/2010 Kern et al. ..... 310/103

* cited by examiner

*Primary Examiner* — Igor Kershteyn
(74) *Attorney, Agent, or Firm* — Timothy J. Klima; Shuttleworth & Ingersoll, PLC

(57) ABSTRACT

A gas turbine includes at least one multi-stage compressor unit 2, with the compressor unit 2 including several, independent compressor modules 3-5, which, independently of each other, are rotatably borne on a drive shaft 1 and are each engageable with the drive shaft 1 by at least one clutch unit 9-11.

17 Claims, 1 Drawing Sheet

Figure 1:
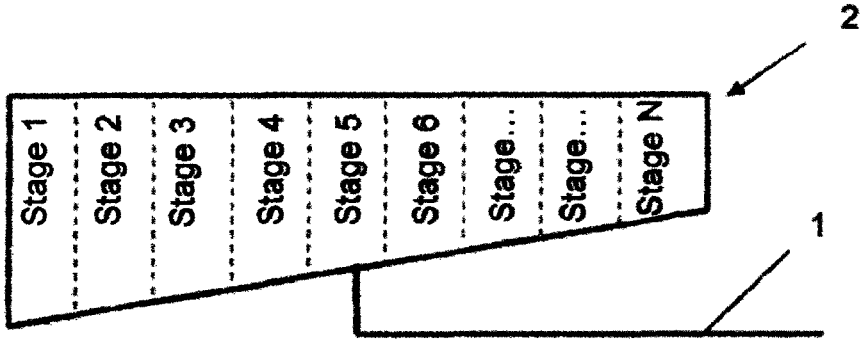
FIG. 1 (PRIOR ART)

GAS TURBINE WITH AT LEAST ONE MULTI-STAGE COMPRESSOR UNIT INCLUDING SEVERAL COMPRESSOR MODULES

This application claims priority to German Patent Application DE102008028883.7 filed Jun. 18, 2008, entirety of which is incorporated by reference herein.

This invention relates to a gas turbine with at least one multi-stage compressor unit.

On multi-stage compressors, e.g. multi-stage high-pressure compressors of aircraft engines, all compressor stages are jointly designed for high-load conditions. However, these compressors are also required to operate at part-load or idle conditions which are characterized by significantly lower compression ratios.

The several compressor stages are jointly designed only for high compression ratios at high-load conditions and are indivisible.

Therefore, part-load or idle operation is restricted to a considerable extent.

The required low compression ratio at part load or idle is distributed to all stages. Therefore, each stage must produce a very small compression ratio. This is not achievable in operation since some stages almost reach their particular, critical surge limits, which are to be avoided, as the entire compressor and, consequently, the whole engine are put at risk.

As counter-measure, the compressor is forced to operate at higher compression ratios in part load or idle. This entails a waste of power and, for example, also fuel. Therefore, the compressor is highly uneconomical in part-load or idle operation which may amount to quite a large part of the total operating time of, for example, an engine.

A broad aspect of the present invention is to provide a gas turbine with at least one multi-stage compressor unit, which while being simply designed, ensures easy and safe operation and can be adapted to different load conditions.

In accordance with the present invention, a gas turbine with at least one multi-stage compressor unit is therefore provided in which the compressor unit is composed of several, independent compressor modules which, independently of each other, are rotatably borne on a drive shaft and, as required, are each engageable with or disengageable from the drive shaft by way of at least one clutch unit.

In accordance with the present invention, provision is made for a multi-stage compressor (e.g. low-pressure, intermediate-pressure and high-pressure compressor) of modular design. This means that the compressor with the matched, indivisible stages is split into suitable compressor modules. Each individual compressor module includes a partial compressor with a suitable number of stages, a suitable bearing arrangement and a suitable clutch (e.g. mechanical, hydraulic, pneumatic, electric, magnetic clutch, frictional-locking clutch etc.) by way of which the partial compressor is, as required, engageable with or disengageable from the drive shaft. The compressor modules can be provided in any number necessary to comply with the respective requirements (without exceeding the number of stages of the total compressor as such).

In compliance with the respective requirements, all compressor modules can be engaged with the drive shaft by way of the clutches to ensure, for example, high compression ratios at maximum load, or any of the compressor modules (all compressor modules, if necessary) may be disengaged from compression or from the drive shaft, respectively, to ensure, for example, small compression ratios at part-load or idle operating conditions. Accordingly, for a number of x modules, a total number of possible combinations of 2 to the power of x is provided. With increasing number of modules, the number of possible combinations will increase correspondingly. Control of the individual compressor modules or the clutches thereof may be accomplished, for example, by the engine-side electronic control unit (EEC: Electric Engine Control). Example for the mode of operation of the modular compressor, e.g. at part load:

The stages which are the earliest to reach their limits in part-load operation are grouped in a compressor module. This compressor module can be disengaged from the drive shaft before the critical limit is reached. It now co-rotates on its specific bearing arrangement, merely driven by the air stream. Consequently, the critical limits for these stages on this disengaged compressor module are avoided, thereby preventing, for example, the entire engine from being put at risk in this operating case. Compressor performance can now be further throttled until the next stages on the next compressor module reach their limits (irrespectively of which compressor module is the next one). Again, this compressor module may be disengaged before its respective limit is reached. This process may be repeated as required.

The present invention is characterized by a number of considerable advantages:

The critical limit of the overall compressor system is shifted to essentially lower compression ratios by suitable disengagements of compressor modules at part load. The compressor is thus enabled to operate at compression ratios in part load that are even lower than those provided for in a previous design. Accordingly, the compressor can be operated in part load or idle, respectively, at optimum compression ratios (and not at unnecessarily high compression ratios at which power and thus fuel, for example, are wasted). Optimization for part load/idle operation, which can amount to quite a large part of the total operating time of an engine, will in general make engine operation substantially more economical.

The individual compressor stages are designed for high stage compression ratios to ensure a design as compact and lightweight as possible.

The modular compressor provides the following operational improvement: If there is a demand for any moderate total compression ratio in part-load operation, as many suitable compressor modules may be disengaged as required to enable the remaining, engaged compressor modules to satisfy this demand. Thus, the stages of engaged compressor modules produce higher stage compression ratios than they would if all compressor modules were active (the demanded total compression ratio is distributed to few "active" stages). The stages of engaged compressor modules, which now operate at comparatively higher compression ratios, have better overall efficiency since all compressor stages are designed for higher compression ratios. Thus, the entire engine, for example, is enabled to operate more efficiently at part-load conditions, thereby saving fuel and improving the economic efficiency of the engine.

With the proposed arrangement, the process of starting the engine is also substantially improved. For engine start, a motor must accelerate a suitable shaft system, which includes a drive shaft, an associated compressor and an associated turbine, from standstill to a minimum rotational speed. As of this speed, the engine is capable of "self-sustained" operation or further acceleration, respectively.

With conventional compressor designs, the compressor must be accelerated in its entirety, resulting in an increase of the inertia of the shaft system. With a given motor power, the time to reach the minimum speed is thus increased, which is undesirable in real flight operation (very low ambient temperatures lead to higher oil viscosity so that even more time will be required to attain the minimum speed, or the minimum speed will not be attained at all). Also, areas with very low compression ratios are entered which are very close to the critical limits. To avoid starting risks, air is therefore bled or discharged from the compressor, which again is uneconomical.

With the arrangement according to the present invention, provision is made that also during the starting procedure suitable compressor modules can be disengaged whose operating points, during the starting procedure, would otherwise be close to the critical limits and, consequently, put the entire engine at risk. With the compressor modules being disengaged, the inertia of the shaft system will be considerably reduced, thereby enabling the shaft system, at a given motor power, to be accelerated distinctly more quickly without approaching the critical limits. If the required minimum speed is reached and sufficient margin to the critical limit ensured, further compressor modules can, as required, be engaged with the drive shaft.

The present invention is more fully described in light of the accompanying drawing showing a preferred embodiment. On the drawing, FIG. 1 is a representation of an embodiment of a compressor unit in accordance with the present invention, and FIG. 2 is a schematic representation of an example of a compressor unit in accordance with the present invention.

The state-of-the-art compressor unit shown in FIG. 1 includes a drive shaft 1 which, in the known manner, is rotated by a turbine or a turbine unit of a gas turbine and is fixedly connected to the individual rotors of the compressor unit 2. The compressor unit 2 includes several stages, as schematically shown in FIG. 1.

Figure 2:
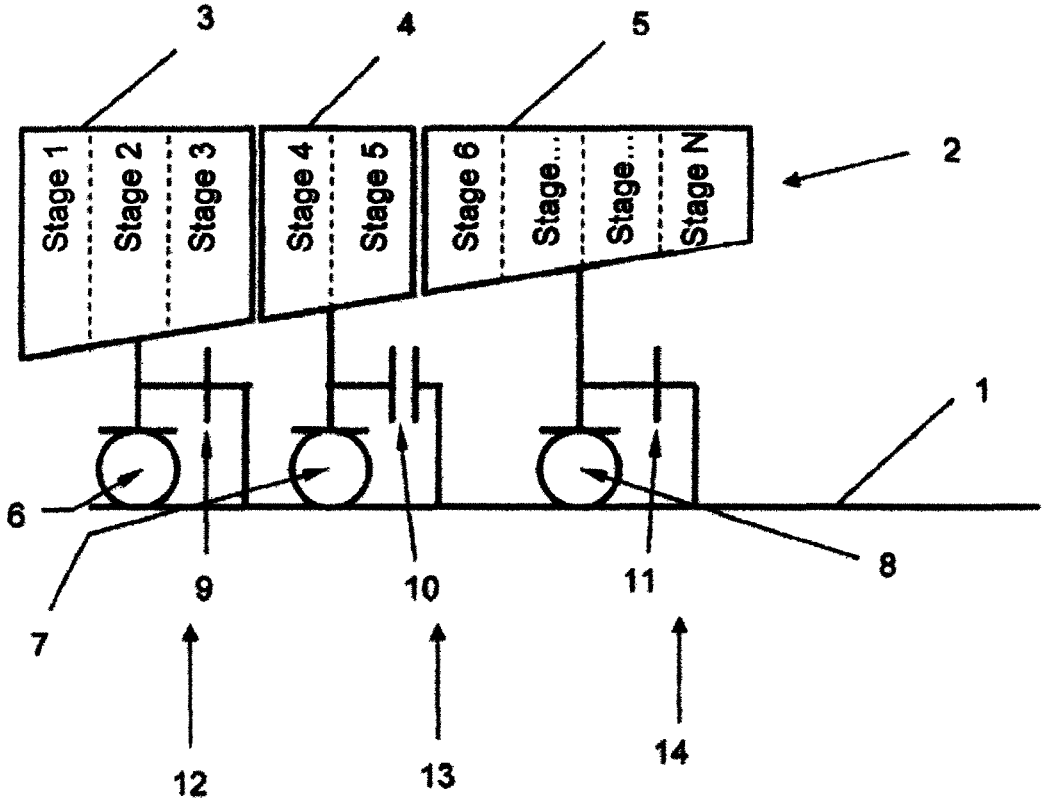

In the example shown in FIG. 2, the compressor unit 2 is divided into individual compressor modules 3, 4, 5. Each of these modules has different compressor stages, each of which, analogically to FIG. 1, includes a rotor and a stator. Each rotor and each stator has at least one row of rotor blades or stator vanes, respectively, as again known from the state of the art.

As conveyed by FIG. 2, the individual compressor modules 3, 4, 5 are each rotatably borne on the drive shaft 1 by way of bearing elements 12, 13, 14 using bearings 6, 7, 8. Thus, independently of the rotation of the drive shaft, the compressor modules 3, 4, 5 can be set into rotation or have a relative speed to the drive shaft 1. While the bearing arrangement by means of the bearings 6, 7, 8 is only schematically shown, it is understood that these bearings provide for both axial and radial location.

A clutch or clutch unit 9, 10, 11 is each provided between the bearing elements 12, 13, 14 and the drive shaft 1. The clutch units 9-11 can be actuated independently of each other. Clutch 10, for example, is shown in the released, disengaged state, while the clutches 9 and 11 are engaged, so that the compressor modules 3 and 5 are anti-rotationally connected to the drive shaft 1, while the compressor module 4 is rotationally connected to the drive shaft 1.

The clutches according to the present invention can be of mechanical, hydraulic, pneumatic or of another type. The clutch units 9-11 can be actuated electrically or hydraulically by suitable servo elements.

List of Reference Numerals

1 Drive shaft
2 Compressor/compressor unit
3-5 Compressor module
6-8 Bearing
9-11 Clutch/clutch unit
12-14 Bearing element

What is claimed is:

1. A gas turbine, comprising:

a drive shaft having an axis about which it is rotatable;

at least one multi-stage compressor unit having a plurality of independent compressor modules, which, independently of each other, are rotatably borne on the drive shaft, each independent compressor module including a compressor stage having a rotor with a plurality of rotor blades disposed circumferentially around the axis of the drive shaft;

a respective clutch unit for each of the plurality of independent compressor modules by which each independent compressor module is engageable with the drive shaft such that the plurality of rotor blades of that independent compressor module is rotationally fixed to the drive shaft around the axis of the drive shaft and disengageable from the drive shaft such that the plurality of rotor blades of that independent compressor module is rotatable with respect to the drive shaft around the axis of the drive shaft.

2. The gas turbine of claim 1, wherein each independent compressor module includes a stator with a plurality of stator vanes.

3. The gas turbine of claim 2, wherein at least one of the independent compressor modules includes a plurality of compressor stages, each having a rotor with a plurality of rotor blades and a plurality of stators, each stator having a plurality of stator vanes.

4. The gas turbine of claim 3, wherein each clutch unit is independently engageable and disengageable.

5. The gas turbine of claim 4, wherein all of the independent compressor modules are independently engageable with and disengageable from the drive shaft.

6. The gas turbine of claim 5, wherein the multi-stage compressor unit is a high-pressure compressor of the gas turbine.

7. The gas turbine of claim 5, wherein the multi-stage compressor unit is a low-pressure compressor of the gas turbine.

8. The gas turbine of claim 1, wherein at least one of the independent compressor modules includes a plurality of compressor stages, each having a rotor with a plurality of rotor blades and a plurality of stators, each stator having a plurality of stator vanes.

9. The gas turbine of claim 1, wherein each clutch unit is independently engageable and disengageable.

10. The gas turbine of claim 1, wherein all of the independent compressor modules are independently engageable with and disengageable from the drive shaft.

11. The gas turbine of claim 1, wherein the multi-stage compressor unit is a high-pressure compressor of the gas turbine.

12. The gas turbine of claim 1, wherein the multi-stage compressor unit is a low-pressure compressor of the gas turbine.

13. A method for starting a gas turbine having a plurality of independent compressor modules rotatably borne on a drive shaft of the gas turbine, comprising:

providing a respective clutch unit for each of the plurality of independent compressor modules by which each independent compressor module is engageable with and disengageable from the drive shaft;

disengaging at least one of the plurality of independent compressor modules from the drive shaft to reduce a load on the drive shaft and allow the drive shaft to be accelerated at a faster rate;

accelerating the drive shaft to a rotational speed sufficient for starting the gas turbine while the at least one of the plurality of independent compressor modules is disengaged from the drive shaft; and after the gas turbine has been started, engaging the at least one of the plurality of independent compressor modules with the drive shaft when operating conditions require the gas turbine to operate at a higher load.

14. The method of claim 13 and further comprising engaging with the drive shaft only a minimum number of the independent compressor modules necessary to start the gas turbine while disengaging the remaining independent compressor modules from the drive shaft until after the gas turbine has started.

15. A method for operating a gas turbine having a plurality of independent compressor modules rotatably borne on a drive shaft of the gas turbine, comprising:

providing a respective clutch unit for each of the plurality of independent compressor modules by which each independent compressor module is engageable with and disengageable from the drive shaft;

disengaging at least one of the plurality of independent compressor modules from the drive shaft during partial load operation of the gas turbine; and engaging the at least one of the plurality of independent compressor modules with the drive shaft when operating conditions require the gas turbine to operate at a higher load.

16. The method of claim 15 wherein disengaging the at least one of the plurality of independent compressor modules from the drive shaft during partial load operation of the gas turbine causes the independent compressor modules that are engaged with the drive shaft to operate at higher stage compression ratios than if all of the independent compressor modules were engaged with the drive shaft.

17. The method of claim 16 and further comprising disengaging an increasing number of the independent compressor modules from the drive shaft as the operation load of the engine decreases.

* * * * *